United States Patent [19]

Bunza et al.

[11] Patent Number: 4,702,696

[45] Date of Patent: Oct. 27, 1987

[54] HIGH TEMPERATURE VACUUM FURNACE

[75] Inventors: Peter Bunza, Flushing; Alan Cross-Hansen, Uniondale, both of N.Y.

[73] Assignee: Denpac Corp., Hackensack, N.J.

[21] Appl. No.: 923,844

[22] Filed: Oct. 28, 1986

[51] Int. Cl.[4] ..... F27B 5/04

[52] U.S. Cl. ..... 432/205; 373/113; 432/83; 432/185; 432/202

[58] Field of Search ..... 432/202, 205, 31, 83, 432/175, 184; 373/113

[56] References Cited

U.S. PATENT DOCUMENTS

| | | | |
|---|---|---|---|
| 3,775,043 | 11/1973 | Johansson et al. | 432/205 |
| 4,131,419 | 12/1978 | Isaksson | 432/205 |
| 4,139,341 | 2/1979 | Pfaffenbauer | 432/205 X |
| 4,332,553 | 6/1982 | Earle et al. | 432/205 |
| 4,596,526 | 6/1986 | Soliman | 432/205 X |

*Primary Examiner*—Edward C. Favors

*Attorney, Agent, or Firm*—Lackenbach Siegel Marzullo & Aronson

[57] ABSTRACT

A vacuum furnace for heating dental reconstruction-products using sintered powder metal that includes a sealed vacuum tube made of a material having a relatively low thermal shock resistance characteristic. The vacuum tube is desirably relatively short. The vacuum tube chamber has a heating chamber and end seals for the vacuum tube have a maximum use temperature of less than 200° C. Insulation is positioned around and connected to the tube proximate the ends of the tube, and heating elements are placed around the heating chamber in an annular insulation chamber formed in the insulation between the insulation and the vacuum tube. Opposed annular clearances extending to positions proximately spaced from the ends of the tube and opening to the central annular insulation chamber are formed between the insulation means and the vacuum tube. The insulation prevents heat from passing to the ends of the tube and overheating the seals there. The annular clearances controls the rate of heat emanating from the heating elements during the heatng process so that the heat generated by the heating elements is absorbed by the tube at a gradual controllable temperature gradient along the length of the tube that is less that the rate of heat gain that would be beyond the tolerance of the thermal shock resistance characteristic of the tube, so that cracking of the tube during heating is avoided.

9 Claims, 2 Drawing Figures

HIGH TEMPERATURE VACUUM FURNACE

BACKGROUND OF THE INVENTION

This invention relates generally to a processor, or high temperature vacuum furnace, preferably for heating dental reconstruction products using sintered powder metal at very high temperatures, and relates more particularly to a special muffle chamber for heating dental reconstruction products in a vacuum environment.

The type of muffle chamber described above includes an elongated muffle tube in which the product to be fired is placed. The interior of the muffle tube defines the vacuum chamber and is first evacuated of atmospheric air so that a high degree of vacuum is achieved. Then the tube is rapidly heated preferably by electrical heating elements until an interior temperature of about 1200° C. (2192° F.) by radiant thermal energy is achieved. The energy passes from the heating elements first to the cylindric wall of the muffle tube and thereupon from the heated tube wall to the product to be fired at the general center of the vacuum chamber formed by the tube.

The primary problem encountered on muffle tubes now in use is that the length of the tube is determined in accordance with thermal shock resistance characteristics of the tubes, its thermal conductivity, and in accordance with the maximum use temperature of silicone rubber seals at the longitudinal ends of the tube that are necessary to maintain the vacuum in the tubes.

Many ceramic materials are unable to withstand sudden changes in temperature without flaking, dunting, spalling, cracking, or other form of disintegration. The extent to which a material can withstand different temperatures along its length without such disintegration or cracking can be referred to as thermal shock resistance, which is often defined in terms of the maximum temperature interval through which the material can be rapidly chilled without fracturing or otherwise disintegrating. A discussion on this subject can be found in *The Chemistry and Physics of Clays and Other Ceramic Materials* by R. W. Grimshaw, Fourth Edition, Wiley-Interscience, New York, 1971, pages 949–955; and in *Glass Ceramics* by P. W. McMillan, Academic Press, New York, 1964, pages 191–193. The thermal shock resistance characteristic is such that a maximum thermal differential, or gradient, per unit length of the tube cannot be exceeded without disintegration of the tube. Because the maximum use temperature of the silicone rubber seals is about 200° C. (392° F.), the longitudinal ends of the tube must be kept below that temperature, and preferably below 150° C. (302° F.). Thus, sufficient length of tube is required to allow cooling from a heating chamber temperature of 1200° C. at its longitudinal center to 150° C. at its ends without exceeding the maximum thermal shock resistance. Therefore, if no insulation were utilized to control the cooling of the tube along its length, and only distance from the heating element allowed cooling, a thermal gradient, possibly only 30° C. (86°) per inch would be achieved. Accordingly, a tube length of about 6 feet, that is, with the ends at about 35 inches from the longitudinal center, would be the necessary result. The cumbersome aspects of such a dimension are apparent, and even more so when the mechanisms associated with the tube, such as electric heating elements, the vacuum apparatus, the outer blowers, and so on, are taken into consideration.

The invention allows for a shortened muffle tube to a more manageable length. The invention includes placing insulation around a shortened tube made of a ceramic material which has a relatively low thermal shock resistance characteristic compared to other materials, such as metals, and the like, but the novel structure of the furnace, maximizes the thermal gradient to come close to the maximum thermal shock resistance of the tube material. Accordingly, the shortest tube length is achieved. Insulation wrapped around the tube placed above and below the center area of the longitudinal dimension of the tube, that is, above and below the heating elements, have resulted in the cracking of the walls of the tube at the point where the insulation began at the walls of the tube in the plane perpendicular to the center axis of the tube upon heating of the tube. This result can be attributed to a too sudden reduction of temperature at the point of juncture between the hot heating chamber and the plane at the insulation wrapping.

SUMMARY OF THE INVENTION

It is therefore an object of the invention to control and uniformize the heating of a relatively short vacuum tube within a furnace for dental reconstruction products using sintered powder metal that is relatively short in length.

It is a further object of the invention to provide a relatively short ceramic vacuum tube which forms a part of a furnace for dental reconstruction products that is subjected to cooling close to its thermal shock resistance, and one that avoids both cracking of the tube and exceeding the maximum use temperature of the vacuum seals at the ends of the tube during the heating mode, at the shortest optimum length.

In accordance with these and other objects of the invention which will become apparent hereinafter, there is provided a vacuum furnace for heating dental reconstruction products using sintered powder metal that includes a sealed cylindrical vacuum tube having a heating chamber, opposed ends, and a length extending between the opposed ends. The tube is made of a ceramic material, which material has a generally low thermal thermal conductivity and therefore a relatively low shock resistance characteristic. Seals having a low maximum use temperature are positioned at the opposed ends, and insulation is positioned around and connected to the vacuum tube proximate the opposed ends.

In addition, stepped clearances formed between the insulation and the tube maximize a controlled uniform cooling of the tube to obtain the shortest possible tube length. The insulation and the clearances are capable of controlling the heat being radiated by the heating elements during the heating process by blocking off a portion or all the lines of radiant energy emanating from the heating elements in the area of the tube at the clearances so that the tube absorbs heat at a gradual temperature gradient along the length of the tube that is less than the thermal gradient of heat differential that would be beyond the tolerance of the thermal shock resistance characteristic of the tube. Thus, cracking of the muffle tube during heating is avoided.

As noted earlier, the maximum use temperature of the seals is approximately 200° C., and it is preferable to keep the ends of the tube no greater than 150° C. A preferred material of the tube is mullite ($3Al_2O_3 \cdot Si_2$);

other materials, however, may be used. The present invention encompasses the utilization of stepped-back insulation designed and configured to maximize and come close to the maximum thermal gradient of the tube, such that a tube of other refractory materials may be constructed to similarly attain the shortest possible length vacuum tube.

The tube has inner and outer surfaces, an axis, and a longitudinal center measured along the longitudinal dimension. The tube includes a heating chamber portion centered at the longitudinal center, and further has first and second tube portions extending between the heating chamber portion and each of the opposed ends; and the insulation is a generally cylindrical insulation block placed around the outer surface and connected to the tube proximate to the opposed ends at first and second connecting areas. The insulation block includes a center block portion aligned with the heating chamber portion and a plurality of block portions generally aligned with the first and second tube portions, respectively, to the first and second connecting areas, respectively.

The stepped clearances include a central clearance formed between the center block portion and the outer surface of the tube, and a plurality of additional clearances formed between the first and second block portions and the outer surface of the tube. The central clearance is aligned with the heating chamber of the muffle tube and is spaced from the outer surface at a first distance and the plurality of additional clearances are spaced from the outer surface at gradually decreasing distances from the first distance to the connecting areas.

The present invention will be better understood, and the objects and important features, other than those specifically enumerated above, will become apparent when consideration is given to the following details and description, which, when taken in conjunction with the annexed drawings, describes and illustrates a preferred embodiment as well as modifications of the invention. Other embodiments or modifications may be suggested to those having the benefit of the teachings herein, and such other embodiments or modifications are intended to be reserved especially as they fall within the scope of the claims following the end of this specification.

DESCRIPTION OF THE PREFERRED EMBODIMENT

Figure 1:
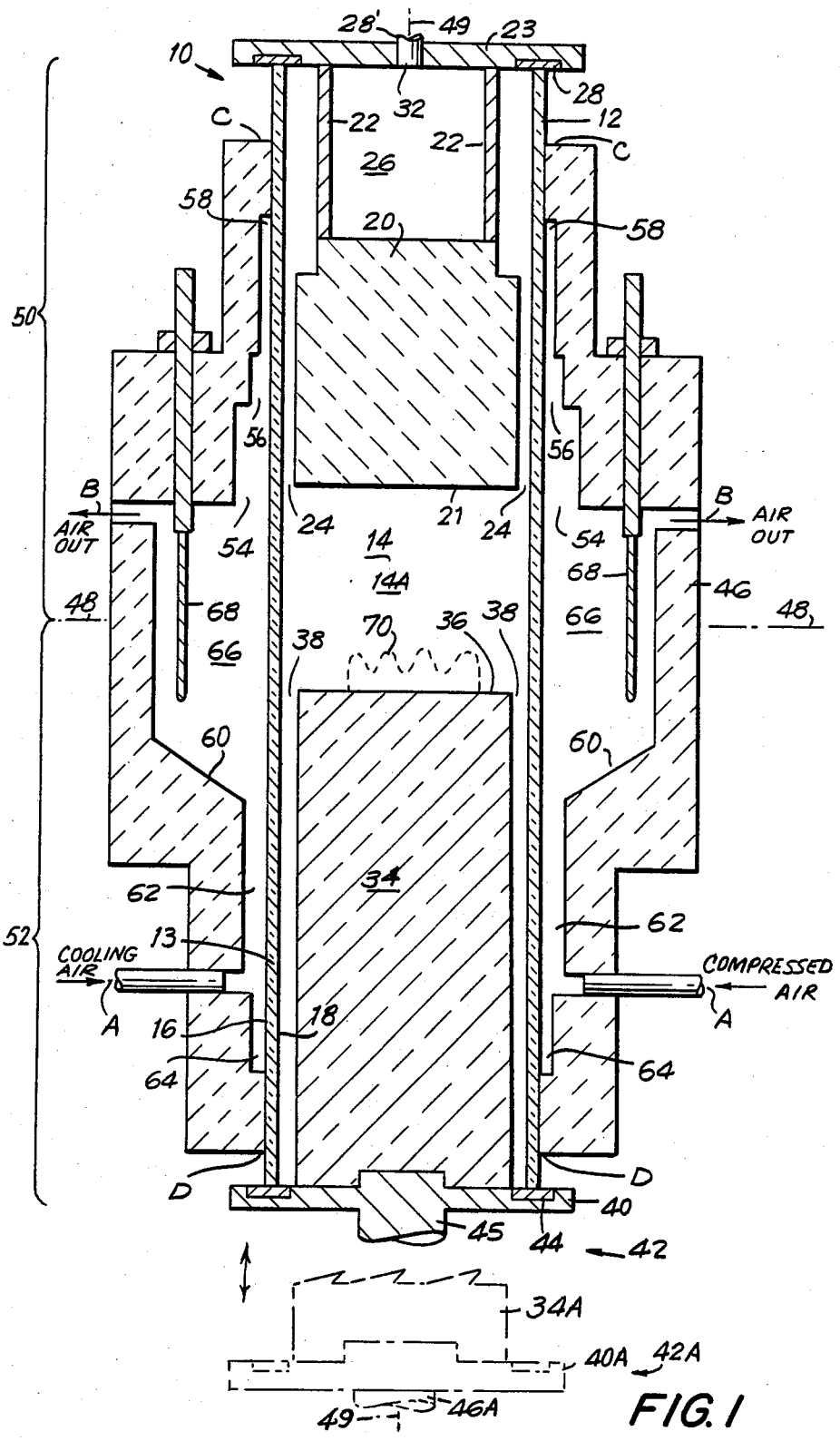
FIG. 1 is a side sectional view of the muffle tube.

Reference is now made to the drawings in which identical or similar parts are designated by the same reference numerals throughout.

FIG. 1 is a sectional view of a processor, or vacuum furnace, 10 for heating dental reconstruction products. Furnace 10 includes a generally vertical muffle tube 12 that includes a cylindrical wall 13 forming a cylindrical chamber 14 and having outer and inner surfaces 16 and 18, respectively. Tube 12 as best shown therein is about 20 inches in length and about 3½ inches to 4 inches in diameter; it is to be understood that the length of tube 12 may vary, but such lengths are short relative to the long muffle tubes presently used by the trade and industry. A generally cylindrical upper insulation block 20 having a bottom planar surface 21 is positioned in the upper portion of chamber 14. Block 20 is suitably hung by a number of brackets 22 from a top cover plate 23 that extends across the open top end of tube 12. An upper annular space, or clearance, 24 is formed between inner surface 18 and cylindrical insulation block 20. Also, a generally annular upper space, or clearance, 26 is formed in chamber 14 between top cover plate 26 and the topside of upper insulation block 20. An annular seal 28 embedded in the bottom side of cover 23 vacuum seals chamber 14 at the top rim of wall 13.

A vacuum tube 28' connected to a vacuum apparatus extends through the top of cover plate 23, through upper clearance 26 where the tube is in fluid connection with chamber 14 at port 32. A cylindrical ceramic table having a table top 36 is positioned in the lower portion of chamber 14 spaced below insulation block 20 so as to define a heating chamber 14A in chamber 14 between planar surface 21 of insulation block 20 and table top 36. Heating chamber 14A is about 6 inches in length. A lower annular space, or clearance, 38 formed between inner surface 18 of wall 13 and cylindrical table 34 extends to a bottom cover plate 40 that extends across the open bottom end of tube 12. An elevator, or lift, 42, which includes bottom cover plate 40, is raised and lowered by a vertical lifting piston 45 comprising a stack of rings operated by lifting machinery (not shown) in turn raises and lowers table 34 between the raised position shown in FIG. 1 and a lowered loading position shown in phantom line as lift 42A with table 34A, bottom cover plate 40A and piston 45A. An annular seal 44 embedded in the top side of bottom cover plate 40 vacuum seals chamber 14 when lift 42 is in the raised position.

A generally cylindrical outer insulation block 46, which comprises a stack of separate insulation rings, is positioned around tube 12 and is attached to upper and lower portions of wall 13. Tube 12 has a longitudinal dimension which has an imaginary center plane 48 that is perpendicular to the axis 49 of tube 12. The longitudinal dimension of tube 12 is divided into equal upper and lower portions 50 and 52 on either side of center plane 48. Insulation block 46 includes a series of preferably separate upper and lower insulation rings around tube 12 relative upper and lower portions 50 and 52. Upper insulation rings include upper first, second and third insulation rings which are slightly spaced from outer surface 16 so as to form upper first, second, and third annular clearances 54, 56, and 58, respectively, which are defined by the inner surfaces of the upper first, second, and third insulation rings and outer surface 16 of wall 13.

In a similar manner, lower insulation rings are slightly spaced from outer surface 16 so as to form annular lower first, second, and third annular clearances 60, 62, and 64, respectively, which are defined by the inner surfaces of the lower first, second, and third insulation rings and outer surface 16 of wall 13. An annular central chamber, or clearance, 66 that extends equally from either side of central plane 48 is defined by the inner diameter, or surface, of the center ring portion of insulation block 46 and outer surface 16 of wall 13; the inner diameter of outer insulation block 46 at this point is greater than the inner diameters of insulation block 46 at the upper and lower insulation rings so that central clearance 66 is larger than the other clearances. A plurality of vertically extending heating elements 68 extend through the upper portion of outer insulation block 46 so that the heating elements are positioned in central clearance 66 at equal intervals around tube 12. A dental reconstruction device 70 is shown in phantom line position on table top 36, which is preferably positioned at the same distance from central plane 48 as is bottom surface 21 if inner insulation block 20 from central plane 48.

Upper first, second, and third clearances 54, 56, and 58 have outside diameters at the inner surfaces of the upper first, second, and third rings of insulation block 46, each successive respective diameter being suitably less than the prior diameter, so that upper first, second, and third clearances 54, 56, and 58 are successively reduced in volume. With this configuration, direct thermal radiation from heating elements 68 to annular clearance 54 is reduced somewhat, and direct thermal radiation to upper annular clearance 56 and lower clearance 62 is greatly reduced. Finally, direct thermal radiation from heating elements 68 to upper clearance 58 and lower clearance 64 is totally blocked. Direct radiation to the clearances mentioned is partially or totally blocked as the case may be by the inner surface of the first, second, and third rings of outer insulation block 46. In addition, during the heating mode of furnace 10, air in central clearance 66 is heated to a very high temperature so that some heat passes from the air to wall 13 of tube 12, although air heating is incidental to the heating of tube 12. Because of convection, conduction, and radiation from the gas, heat reaches into the depths of the clearances, including clearances 58 and 64. It is to be noted that the clearances is to pass significant amounts of heat to wall 13 during the heating mode, but at a slightly reduced rate than heat passed to the walls of furnace area 14A. In addition, the clearances also pass heat along a longitudinal area of the wall 13 at a thermal gradient which is well within the temperature differential that the wall material 13 can tolerate without cracking during the heating mode.

The clearance between outer surface 16 of wall 13 of tube 12 and the inside diameter of outer insulation block 46 varies from large to small to zero over the insulated length of the tube taken from center plane 48 with the largest clearance being at the hot zone at central clearance 66. It is to be noted that although the clearances are shown as a series of stepped clearances, it is possible and within the scope of the invention to have a continuous angled, or tapered, inner surface along the inner surface of insulation block 46 rather than the separate rings forming the steps shown, provided that the proper amount of direct radiation from heating elements is blocked from wall 13 in the same manner described with respect to the stepped clearances noted hereinabove.

During the heating mode of furnace 10, wall 13 of tube 12 will be receive radiant energy from heating elements 68. This energy will be transmitted by radiation through vacuum chamber 14A to dental reconstruction device 70. The preferable temperature at the dental device is about 1200° C. Wall 13 is heated to about this temperature at the area around center plane 48. Conductive heat will pass along wall 13 from either side of center plane 48 to the upper and lower rim areas of wall 13. The upper and outer end portions of wall 13 extend somewhat, preferably about 1 inch, beyond outer insulation block 46 so that energy at those areas is allowed to pass directly into the atmosphere at these uninsulated portions so as to accelerate heat reduction at the seals to below the maximum use temperature of the seals. It is noted that conduction along wall 13 will transfer heat from the area of chamber **14*a* towards the opposed rims of wall 13. Finally, convection of heated air in the clearances will pass heat to wall 13**. These factors all contribute and enter into the overall analysis concerning the configuration and dimensions of the various stepped clearances.

A broad calculation of the thermal gradient required with outer insulation block 46 is as follows. The temperature in the working heating chamber 14A is about 1200° C. The preferable maximum temperature at the end seals 28 and 44 is about 150° C., which leaves a temperature reduction of about 1050° C. in the 7 inches between each end of heating chamber 14A and end seals 28 and 44 with the result that the temperature gradient of each of those 7 inches is not greater than 150° C. per inch, which is well within the thermal shock resistance characteristic, or thermal endurance of tube 12 so as to avoid cracking of tube 12.

Tube 12 is preferably made of a material that has a low thermal conductivity, such as a ceramic. Ceramics, however, compared to other materials, such as metals, and the like, have a relatively low thermal shock resistance characteristic. One material that has been found to be satisfactory is mullite, a mixture of alumina and silica ($3Al_2O_3 \cdot SiO_2$). Other materials having similar characteristics could be used, such as alumina or zirconia.

Figure 2:
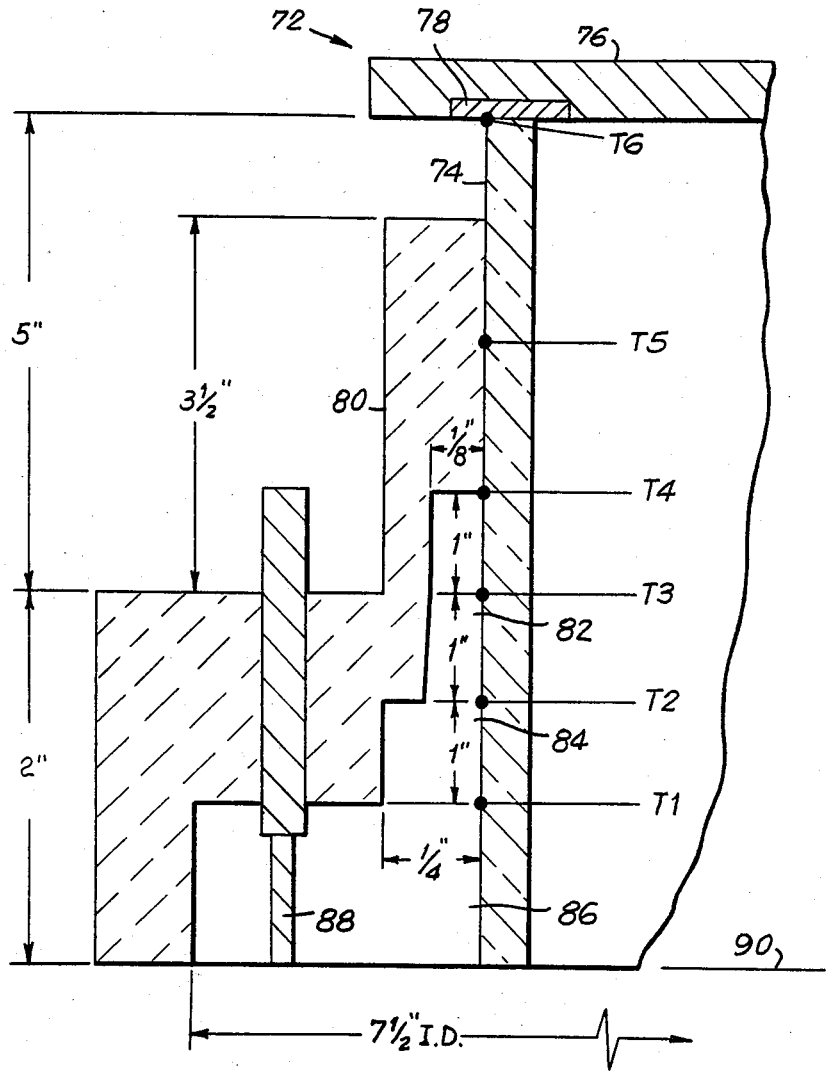
FIG. 2 is partial section view of a prototype model utilized in tests.

Reference is made herein to a test made on a prototype model of the invention, which is illustrated in FIG. 2, and shown partially in cross-section. As shown therein, the furnace 72 includes a cylindrical muffle tube 74 having a top cover 76 and having a vacuum seal 78 that seals the top rim of tube 74. Outer insulation block 80 forms upper and lower annular clearances 82 and 84, respectively, and central annular clearance 86 into which heating elements 88 extend is centered on the midplane 90. The dimensions as shown in FIG. 2 are $\frac{1}{8}$ inch across and 2 inches longitudinally for upper clearance 82, $\frac{1}{4}$ inch across and 1 inch longitudinally for lower clearance 84, and $7\frac{1}{4}$ inches inner diameter for center clearance 86. Measuring points for temperature during the heating mode were placed as follows: T1 at the bottom of bottom clearance 84; T2 at the bottom of clearance 82; T4 at the top of clearance 82; T5 midway between T4 and the top rim of tube 74 at seal 78; and T6 at the top rim of tube 74 at seal 78. The distance between T1 and T6 is 7 inches; between T3 and T6 is 5 inches; and between midplane 90 of furnace model 72 and T3 is 2 inches. Furnace prototype model 72 was heated and temperature measurements were taken at points T1, T2, T3, T4, T5, T6 with the results shown hereinbelow in Table I:

TABLE I

| | MUFFLE TUBE TEMPERATURE °F. (°C.) | | | | | |
|---|---|---|---|---|---|---|
| TIME | T1 | T2 | T3 | T4 | T5 | T6 |
| 0 | 661 | 575 | 460 | 352 | 266 | 123 |
| | (349) | (302) | (238) | (178) | (130) | (51) |
| 2 | 817 | 598 | 469 | 360 | 275 | 128 |
| | (436) | (314) | (243) | (182) | (135) | (53) |
| 4 | 916 | 649 | 490 | 375 | 285 | 134 |
| | (491) | (343) | (254) | (191) | (141) | (57) |
| 6 | * | 778 | 548 | 404 | 305 | 143 |
| | | (414) | (287) | (207) | (152) | (62) |
| 8 | 1569 | 992 | 674 | 471 | 348 | 154 |
| | (854) | (533) | (357) | (244) | (176) | (68) |
| 10 | 1802 | 1245 | 865 | 586 | 415 | 163 |
| | (983) | (674) | (463) | (308) | (213) | (73) |
| 12 | 1975 | 1480 | 1092 | 750 | 510 | 175 |
| | (1079) | (804) | (589) | (399) | (266) | (79) |
| 14 | 2101 | 1676 | 1312 | 956 | 629 | 188 |
| | (1149) | (913) | (711) | (513) | (332) | (87) |

TABLE I-continued

| TIME | MUFFLE TUBE TEMPERATURE °F. (°C.) T1 | T2 | T3 | T4 | T5 | T6 |
|---|---|---|---|---|---|---|
| 16 | 1943 (1062) | 1721 (938) | 1445 (785) | 1123 (606) | 733 (389) | 177 (81) |
| 18 | 1785 (974) | 1666 (908) | 1445 (791) | 1176 (636) | 776 (413) | 170 (77) |
| 21 | 1613 (878) | 1559 (848) | 1402 (761) | 1165 (629) | 800 (427) | 166 (74) |
| 22 | 1563 (851) | 1521 (827) | 1375 (746) | 1150 (621) | 791 (422) | 166 (74) |
| 26 | 1415 (768) | 1389 (754) | 1269 (687) | 1069 (576) | 755 (402) | 166 (74) |
| 30 | 1302 (706) | 1282 (694) | 1174 (634) | 922 (533) | 707 (375) | 168 (76) |

*No data

TABLE II

| TIME | THERMAL GRADIENT °F./inch; (°C./inch) T1-T2 | T2-T3 | T3-T4 | T4-T5 | T5-T6 |
|---|---|---|---|---|---|
| 0 | 86 (43) | 115 (64) | 108 (60) | 43 (24) | 72 (40) |
| 2 | 219 (122) | 129 (72) | 109 (61) | 43 (24) | 74 (41) |
| 4 | 267 (148) | 159 (88) | 115 (64) | 45 (25) | 76 (42) |
| 6 | * | 230 (128) | 144 (80) | 50 (28) | 81 (45) |
| 8 | 577 (321) | 318 (177) | 203 (113) | 62 (34) | 97 (54) |
| 10 | 577 (309) | 380 (211) | 279 (155) | 86 (48) | 126 (70) |
| 12 | 495 (275) | 388 (216) | 342 (190) | 120 (67) | 168 (93) |
| 14 | 425 (236) | 364 (202) | 356 (198) | 164 (91) | 221 (123) |
| 16 | 222 (123) | 276 (153) | 322 (179) | 195 (108) | 278 (154) |
| 18 | 119 (66) | 211 (117) | 279 (155) | 200 (111) | 303 (168) |
| 21 | 54 (30) | 157 (87) | 237 (132) | 183 (101) | 317 (176) |
| 22 | 42 (23) | 146 (81) | 225 (125) | 180 (100) | 313 (174) |
| 24 | 26 (14) | 120 (67) | 200 (111) | 157 (87) | 295 (164) |
| 30 | 20 (11) | 108 (60) | 182 (101) | 143 (79) | 270 (150) |

*No data

In the prototype furnace tested, the end temperature is shown to have risen to 87° C. (188° F.), which is below the 200° C. (392° F.) maximum use temperature of any silicone rubber seal positioned at the ends of the muffle tube.

High temperature furnaces using conventional construction cool down very slowly. This is particularly the case when the tube cannot be opened and flushed with a cooling gaseous medium, which is the case with furnace 10. The metal sintering process is carried out in furnace 10 at temperatures up to 1200° C. and at vacuums of 100 microns (100 millitorrs) or less. After the alloy is sintered, furnace 10 cannot be opened until the internal temperature in the tube falls below the oxidation temperature of the sintered alloy. Typically this may require a drop of 500° to 600° C. in the furnace. Cooling the entire furnace by blowing air over the entire surface of prior art furnaces is not possible because of the insulation surrounding the heating elements and heating chamber. The prevention of heat losses during heating by means of the insulation also prevents effective cooling by cooling the external surfaces. The time of the cooling cycle is directly related to the rate of production of the work being processed by increasing the use time of the furnace in a production day.

This invention overcomes the problem by introducing compressed air during the cooling phase at several inlet ports A in insulation 46 opening into the lower clearances, optionally into lower clearance 62 as shown in FIG. 1. The compressed air escapes at several outlet ports B in insulation 46 opening into a clearance spaced from clearances A, optionally central clearance 66. Some of the compressed cooling air will also escape from upper and lower annular clearances C and D between tube 12 and insulation 46 where the fit, although tight, is not tight enough to prevent some air under pressure from passing from the clearances. Ports A are small, in the order of $\frac{1}{4}$ inch diameter, and ports B are preferably smaller, in the order of $\frac{1}{8}$ inch diameter in order to prevent excessive heat loss during the heating mode. It is desirable to use oil-free air for the cooling process so as to prevent the contamination of heating elements 68 and the outside of tube 12. The cooling process is done while the high vacuum in tube 12 is maintained. This inventive feature reduces the cooling time of the sintering process in the range of 30 percent as compared to the prior art method of merely directing air from a blower to cool the exposed outer surface of the furnace.

It is to be understood that the invention particularly described herein is not to be considered limited to the details set forth above, but that if various modifications and changes of the embodiment described occur to those skilled in the art, these are to be regarded as within the scope of the invention as defined by the appended claims.

What is claimed is:

1. A vacuum tube furnace for heating dental reconstruction products using sintered powder metal, said vacuum tube having a heating chamber, opposed ends, and a length extending between said opposed ends, and sealing means for sealing said vacuum tube at said opposed ends, said sealing means having a maximum use temperature, comprising, in combination, said tube being relatively short and made of a material being able to withstand a relatively low thermal shock resistance characteristic, the length of said tube being such that the temperature at said sealing means remains below said maximum use temperature, insulation means positioned around and connected to said tube proximate said opposed ends, said insulation means forming a central chamber spaced from said tube in alignment with said heating chamber, heating means positioned in said central chamber spaced around said tube, and opposed annular clearance means formed between said insulation means and said tube extending to positions equally spaced from said opposed ends of said tube, each of said clearance means opening to said central chamber, said clearance means being for controlling the absorption rate by said vacuum tube of heat emanating from said heating means during the heating process so that the heat is absorbed by said tube at a gradual controlled temperature gradient along the entire length of said tube that is less than the thermal shock resistance characteristic of said tube, whereby the furnace does not subject said tube a thermal gradient of more than 350° C. per inch during heating.

2. The vacuum tube furnace according to claim 1, wherein said relatively low thermal shock resistance characteristic of said tube is no greater than 400° C. per inch at any point along said tube during breathing.

3. The vacuum tube furnace according to claim 1, wherein said maximum use temperature of said seal means is approximately 200° C.

4. The furnace vacuum tube according to claim 2, wherein said material of said tube is mullite ($3Al_2O_3 \cdot Si_2$).

5. The vacuum tube furnace according to claim 2, wherein said tube includes a heating chamber portion centered at the longitudinal center of said tube, and further having first and second tube portions extending between said heating chamber portion and each of said opposed ends; and said insulation means is a generally cylindrical insulation block placed around said tube and connected to said tube proximate to said opposed ends at first and second connecting areas, said insulation block including a center block portion aligned with said heating chamber portion and first and second block portions generally aligned with said first and second tube portions, respectively, extending to said to said first and second connecting areas, respectively, said center block portion forming said annular chamber.

6. The vacuum tube furnace according to claim 5, wherein said opposed annular clearance means is in the form of a plurality of clearances defined between said first and second block portions and said tube, said central chamber being spaced from said tube at a first distance and said plurality of clearances being spaced from said tube at gradually decreasing distances from said first distance to a location spaced from said connecting areas.

7. The vacuum tube furnace according to claim 6, wherein said plurality of clearances is in the form of a plurality of gradually narrowing stepped clearances.

8. The vacuum tube furnace according to claim 5, wherein said first and second connecting areas are spaced from said opposed ends, whereby heat will be absorbed by the atmosphere from said tube between said first and second connecting ends and said opposed ends.

9. The vacuum tube furnace according to claim 1, further including said insulation means forming a plurality of inlet ports and a plurality of outlet ports spaced from said inlet ports, said inlet and outlet ports opening into said clearance means, and a source of compressed air connected to said inlet ports, whereby compressed air can be introduced into the clearance means during the cooling mode of said furnace so that the vacuum tube is cooled by the passage of air between the inlet and outlet ports.

* * * * *